United States Patent [19]
Freeman

[11] Patent Number: 4,483,722
[45] Date of Patent: Nov. 20, 1984

[54] LOW ALLOY COLD-WORKED MARTENSITIC STEEL

[76] Inventor: Timothy J. Freeman, 3772 River La., Rocky River, Ohio 44116

[21] Appl. No.: 381,197

[22] Filed: May 24, 1982

[51] Int. Cl.[3] ..... C21D 8/00
[52] U.S. Cl. ..... 148/12 B; 148/12.4; 148/36
[58] Field of Search ..... 148/12 B, 12 F, 12.4, 148/36

[56] References Cited

U.S. PATENT DOCUMENTS 3,379,582 4/1968 Dickinson ..... 148/36

FOREIGN PATENT DOCUMENTS 2238768 2/1975 France ..... 148/12 B
44122 11/1972 Japan ..... 148/12.4
782356 9/1957 United Kingdom ..... 148/12.4

OTHER PUBLICATIONS

Iron Age, Feb. 7, 1963, "Steel Bars Climb to 400,000 psi", pp. 85–87.

*Primary Examiner*—Peter K. Skiff
*Attorney, Agent, or Firm*—Pearne, Gordon, Sessions, McCoy, Granger & Tilberry

[57] ABSTRACT

A method of producing a low carbon, low alloy, martensitic, cold-worked steel is disclosed. A low alloy steel is provided having the ability to form an essentially martensitic structure upon air cooling from a temperature above its $A_{cl}$. The steel is austenitized and then air cooled to form a martensitic structure. The steel is tempered and then cold-worked to reduce its cross section by about 1/32 to ⅛ inch to increase its tensile and yield strengths while at least maintaining its tempered hardness.

6 Claims, No Drawings

LOW ALLOY COLD-WORKED MARTENSITIC STEEL

BACKGROUND OF THE INVENTION

Mechanical properties of high strength steels generally depend upon melting practices, alloying elements, and heat treatments to provide particular mechanical characteristics for the intended purpose of the steel. High strength steel characterized by high tensile strengths, yield strengths, and toughness generally require strengthening, toughening, and hardening elements to attain the desired properties. As a general rule, alloying elements in steel promote a general decrease in the rate of austenite transformation to other phases, such as pearlite, bainite, and martensite, depending upon the rate of cooling. Typical alloying ingredients to enhance mechanical properties of steel are chromium, manganese, molybdenum, nickel, and silicon. Chromium increases the resistance to corrosion and oxidation, while increasing hardenability and promoting strength at high temperatures. Manganese increases the hardenability, and is relatively inexpensive. Molybdenum raises the grain coarsening temperature of austenite, deepens hardening, counteracts temper brittleness, and raises hot and creep strengths of the steel. Nickel strengthens unquenched steels, while silicon strengthens low alloy steels.

It has been the objective of metallurgists to provide optimum mechanical properties in steels while employing relatively low percentages of alloying elements. An example of such efforts is represented by the disclosure of U.S. Pat. No. 3,379,582, the disclosure of which is incorporated herein by reference, wherein the patentee produces a low alloy, high strength steel having a martensitic microstructure. According to that patent, the patentee provides an iron base alloy having from 0.20% to 0.30% carbon, 0.80% to 1.2% manganese, 3.25% to 4.00% nickel, 1.25% to 2.00% chromium, 0.25% to 0.50% molybdenum, 0.20% to 0.50% silicon and residual amounts of other elements. The patentee heat treats the alloy by heating above the critical temperature to form austenite, and then preferably air-cools the steel to form a martensitic microstructure. The alloying ingredients permit slow cooling by decreasing the rate of austenite transformation so that the microstructure is substantially all martensitic. The steel is tempered at about 500° F. to raise the yield strength to 170,000 psi or higher and to slightly decrease the ultimate tensile strengths to about 215,000 psi. The hardness obtained in 5-inch and 8-inch sections was at least Rockwell C 38 (about 365 Brinell), which was measured at the bar center. Thus, the alloy produced by the patentee exhibits excellent tensile and yield strengths, while maintaining a relatively high hardness. Because of the ability of this alloy to air-cool to a martensitic structure, it was believed that the alloy could be formed into useful shapes by hot working techniques. It was assumed that cold working such a hard martensitic alloy would result in cracking, and that such working would deleteriously increase the hardness while reducing the ductility of the steel. As a general rule, cold working increases the tensile strength and hardness of the steel, while it reduces ductility, percentage elongation, and yield strength.

SUMMARY AND DETAILED DESCRIPTION OF THE INVENTION

This invention provides a technique for producing a low alloy, high strength, martensitic steel which is cold-worked in such a manner as to increase tensile strength and yield strength whie maintaining the as-tempered hardness of the steel.

According to this invention, a low alloy, high strength steel is prepared generally according to the teachings of U.S. Pat. No. 3,379,582, the subject matter of which is incorporated herein by reference. That is to say, a melt is prepared containing between about 0.20% to 0.30% carbon, 0.80% to 1.2% manganese, 3.25% to 4.00% nickel, 1.25% to 2.00% chromium, 0.25% to 0.50% molybdenum, 0.20% to 0.50% silicon, and the balance iron with residual amounts of other elements. A specific example of such an alloy was prepared having 0.20% carbon, 0.90% manganese, 3.45% nickel, 1.45% chromium, 0.30% molybdenum, and 0.28% silicon. The alloy was prepared by conventional vacuum degassing techniques in an electric arc furnace and was then cast into ingots. The ingots were hot forged to rods 1.5 inches (Table I), 2 inches (Table II), 3 inches (Table III), and 4 inches (Table IV) in diameter. After cooling, the rods were normalized at an austenitizing temperature above the $A_{c1}$ temperature of the alloy. A typical normalizing temperature for the alloy set forth above is 1750° F. Substantially higher temperatures tend to cause grain coarsening with deleterious effects upon subsequent transformations. After through heating the rods, the rods were cooled in still air to a temperature below the $M_s$ temperature of the steel to transform the steel to an essentially martensitic structure. Thereafter the rods were tempered by heating the rods to a temperature below their $A_1$ temperature. Alternately, the rods could be martempered by cooling the steel from its austenitizing temperature to a temperature below its $A_1$ by, for example, quenching the austenitized steel in molten salt maintained at the desired tempering temperature. After the tempering step, some of the rods, as noted below, were cold-worked by reducing their diameter between about 1/32 and ⅛ inch, and preferably between about 1/32 and 1/16 inch. After cold working, the bars may be straightened by employing a Medart straightener, which not only straightens the bar but adds a degree of polish.

The cold-worked rods exhibited the following properties as compared to samples which were hot-rolled and heat-treated. In the following Tables, all of the samples were subjected to the identical heat treatment as set forth above, but samples 1, 2, and 3 were cold drawn, while samples 11, 22 and 33 were cold drawn and straightened.

TABLE I

| Sample | Size Inches | Tensile Strength psi | Yield Strength psi 0.2% offset | Elong. % in "2" | Red. of Area % | Hardness BHN |
|---|---|---|---|---|---|---|
| A | 1.495 | 161,500 | 149,500 | 16.0 | 57.8 | 363 |
| | 1.500 | | | | | |
| 1 | 1.489 | 159,500 | 149,000 | 15.0 | 60.1 | 341 |
| | 1.494 | | | | | |
| 11 | 1.489 | 176,000 | 170,000 | 12.0 | 54.1 | 341 |
| | 1.494 | | | | | |
| B | 1.508 | 171,000 | 152,500 | 16.0 | 55.7 | 363 |
| | 1.511 | | | | | |

TABLE I-continued

| Sample | Size Inches | Tensile Strength psi | Yield Strength psi 0.2% offset | Elong. % in "2" | Red. of Area % | Hardness BHN |
|---|---|---|---|---|---|---|
| 2 | 1.461 | 177,500 | 172,500 | 11.0 | 55.7 | 341 |
| | 1.462 | | | | | |
| 22 | 1.461 | 180,000 | 163,000 | 11.5 | 50.8 | 363 |
| | 1.462 | | | | | |
| C | 1.502 | 171,000 | 153,000 | 17.0 | 56.8 | 363 |
| | 1.504 | | | | | |
| 3 | 1.442 | 184,500 | 180,000 | 11.0 | 52.5 | 341 |
| 33 | 1.4405 | 186,000 | 177,000 | 11.00 | 53.4 | 363 |
| | 1.4410 | | | | | |

A, B, C = Hot Rolled
1, 2, 3 = Cold Drawn between 1/32 and ⅛ inch
11, 22, 33 = Cold Drawn between 1/32 and ⅛ inch and straightened

TABLE II

| Sample | Size Inches | Tensile Strength psi | Yield Strength psi 0.2% offset | Elong. % in "2" | Red. of Area % | Hardness BHN |
|---|---|---|---|---|---|---|
| D | 3.031 | 156,750 | 133,250 | 16.0 | 50.8 | 341 |
| | 3.052 | | | | | |
| D | 3.031 | 156,750 | 133,500 | 16.0 | 54.4 | 341 |
| | 3.052 | | | | | |
| 1 | 2.987 | 165,000 | 162,500 | 11.5 | 51.1 | 352 |
| | 2.989 | | | | | |
| 1 | 2.987 | 165,500 | 163,250 | 12.5 | 51.1 | 352 |
| | 2.989 | | | | | |
| 11 | 2.990 | 175,500 | 173,750 | 12.0 | 51.4 | 363 |
| | 2.991 | | | | | |
| 11 | 2.990 | 176,000 | 164,250 | 12.0 | 50.0 | 363 |
| | 2.991 | | | | | |
| E | 3.026 | 156,000 | 135,000 | 15.5 | 50.8 | 341 |
| | 3.045 | | | | | |
| E | 3.026 | 156,750 | 136,250 | 16.0 | 53.3 | 341 |
| | 3.045 | | | | | |
| 2 | 2.986 | 162,000 | 159,000 | 13.0 | 53.2 | 341 |
| | 2.988 | | | | | |
| 2 | 2.986 | 161,000 | 157,500 | 12.0 | 54.7 | 341 |
| | 2.988 | | | | | |
| 22 | 2.887 | 174,000 | 171,500 | 11.0 | 48.6 | 363 |
| | 2.991 | | | | | |
| 22 | 2.887 | 175,000 | 172,500 | 11.5 | 49.5 | 363 |
| | 2.991 | | | | | |
| F | 3.023 | 161,000 | 139,000 | 16.0 | 52.2 | 352 |
| | 3.048 | | | | | |
| F | 3.023 | 161,500 | 135,000 | 15.0 | 50.0 | 352 |
| | 3.048 | | | | | |
| 3 | 2.987 | 170,000 | 166,250 | 12.0 | 50.0 | 363 |
| | 2.989 | | | | | |
| 3 | 2.987 | 170,750 | 168,250 | 11.0 | 48.1 | 363 |
| | 2.989 | | | | | |
| 33 | 2.990 | 177,500 | 172,500 | 11.5 | 48.4 | 363 |
| | 2.993 | | | | | |
| 33 | 2.990 | 181,500 | 180,000 | 10.5 | 46.9 | 363 |
| | 2.993 | | | | | |

D, E, F = Hot Rolled
1, 2, 3 = Cold Drawn between 1/32 and ⅛ inch
11, 22, 33 = Cold Drawn between 1/32 and ⅛ inch and straightened

TABLE III

| Sample | Size Inches | Tensile Strength psi | Yield Strength psi 0.2% offset | Elong. % in "2" | Red. of Area % | Hardness BHN |
|---|---|---|---|---|---|---|
| G | 2.014 | 156,750 | 138,000 | 17.0 | 57.8 | 341 |
| | 2.020 | | | | | |

TABLE III-continued

| Sample | Size Inches | Tensile Strength psi | Yield Strength psi 0.2% offset | Elong. % in "2" | Red. of Area % | Hardness BHN |
|---|---|---|---|---|---|---|
| G | 2.014 | 155,750 | 135,500 | 17.0 | 57.3 | 341 |
| | 2.020 | | | | | |
| 1 | 1.993 | 162,500 | 157,000 | 17.0 | 57.8 | 341 |
| | 1.995 | | | | | |
| 1 | 1.993 | 163,500 | 156,000 | 15.0 | 56.8 | 341 |
| | 1.995 | | | | | |
| 11 | 1.993 | 165,770 | 160,000 | 13.5 | 55.7 | 352 |
| | 1.996 | | | | | |
| 11 | 1.993 | 165,000 | 152,000 | 14.5 | 56.2 | 352 |
| | 1.996 | | | | | |
| H | 2.014 | 164,000 | 147,500 | 17.0 | 56.0 | 363 |
| | 2.026 | | | | | |
| H | 2.014 | 165,000 | 145,500 | 16.5 | 54.4 | 363 |
| | 2.026 | | | | | |
| 2 | 1.994 | 168,500 | 163,500 | 15.0 | 56.0 | 352 |
| | 1.996 | | | | | |
| 2 | 1.994 | 168,500 | 162,500 | 13.0 | 53.8 | 352 |
| | 1.996 | | | | | |
| 22 | 1.992 | 174,000 | 170,000 | 11.5 | 50.3 | 363 |
| | 1.996 | | | | | |
| 22 | 1.992 | 174,000 | 165,000 | 13.0 | 54.7 | 363 |
| | 1.996 | | | | | |
| J | 2.012 | 165,000 | 146,250 | 16.5 | 54.7 | 363 |
| | 2.021 | | | | | |
| J | 2.012 | 164,500 | 146,000 | 16.5 | 54.9 | 363 |
| | 2.021 | | | | | |
| 3 | 1.994 | 170,500 | 167,500 | 12.0 | 50.6 | 341 |
| | 1.996 | | | | | |
| 3 | 1.994 | 169,000 | 168,500 | 12.0 | 53.0 | 341 |
| | 1.996 | | | | | |
| 33 | 1.993 | 172,500 | 166,750 | 12.0 | 51.9 | 363 |
| | 1.994 | | | | | |
| 33 | 1.993 | 172,500 | 166,750 | 12.0 | 52.5 | 363 |
| | 1.994 | | | | | |

G, H, J = Hot Rolled
1, 2, 3 = Cold Drawn between 1/32 and ⅛ inch
11, 22, 33 = Cold Drawn between 1/32 and ⅛ inch and straightened

TABLE IV

| Sample | Size Inches | Tensile Strength psi | Yield Strength psi 0.2% offset | Elong. % in "2" | Red. of Area % | Hardness BHN |
|---|---|---|---|---|---|---|
| K | 4.022 | 159,250 | 135,000 | 16.0 | 53.8 | 352 |
| | 4.032 | | | | | |
| K | 4.022 | 158,750 | 137,500 | 16.5 | 54.7 | 352 |
| | 4.032 | | | | | |
| 1 | 3.996 | 162,500 | 162,500 | 13.0 | 53.3 | 341 |
| | 3.999 | | | | | |
| 1 | 3.996 | 167,500 | 165,000 | 12.0 | 55.2 | 341 |
| | 3.999 | | | | | |
| 11 | 3.998 | 165,000 | 165,000 | 14.0 | 55.2 | 341 |
| | 4.000 | | | | | |
| 11 | 3.998 | 162,500 | 161,000 | 14.0 | 53.8 | 341 |
| | 4.000 | | | | | |
| L | 4.030 | 159,500 | 139,000 | 16.0 | 55.5 | 352 |
| | 4.042 | | | | | |
| L | 4.030 | 160,000 | 139,500 | 16.0 | 54.1 | 352 |
| | 4.042 | | | | | |
| 2 | 3.995 | 160,750 | 156,500 | 15.0 | 55.5 | 352 |
| | 3.999 | | | | | |
| 2 | 3.995 | 161,500 | 157,500 | 13.5 | 51.7 | 352 |
| | 3.999 | | | | | |
| 22 | 3.994 | 163,750 | 163,750 | 12.5 | 53.3 | 341 |
| | 3.997 | | | | | |
| 22 | 3.994 | 163,750 | 163,500 | 12.0 | 52.2 | 341 |

TABLE IV-continued

| Sample | Size Inches | Tensile Strength psi | Yield Strength psi 0.2% offset | Elong. % in "2" | Red. of Area % | Hardness BHN |
|---|---|---|---|---|---|---|
| M | 3.997 / 4.023 | 156,500 | 134,500 | 16.0 | 52.2 | 363 |
| M | 4.033 / 4.023 | 157,500 | 133,250 | 16.5 | 55.5 | 363 |
| 3 | 4.033 / 3.996 | 161,250 | 161,250 | 14.0 | 54.4 | 331 |
| 3 | 3.999 / 3.996 | 159,500 | 159,500 | 14.0 | 53.6 | 331 |
| 33 | 3.999 / 3.994 | 158,250 | 155,000 | 13.5 | 54.4 | 331 |
| 33 | 3.996 / 3.994 | 158,000 | 157,500 | 13.0 | 53.8 | 331 |
| | 3.996 | | | | | |

K, L, M = Hot Rolled
1, 2, 3 = Cold Drawn between 1/32 and ⅛ inch
11, 22, 33 = Cold Drawn between 1/32 and ⅛ inch and straightened As may be seen, hot rolled samples A, B, C, D, E, F, G, H, J, K, L, and M exhibit excellent tensile strengths, yield strengths, elongation, and hardness. With such steels, increases in tensile strengths and yield strengths are to be expected upon cold rolling or drawing. It would also be expected that hardness would increase along with tensile and yield strengths. However, as is evident from the foregoing Tables, the Brinell hardness in many cases remained the same after cold working with a reduction in diameter of between 1/32 and ⅛ inch, while, surprisingly, in some of the cases, the Brinell hardness actually dropped.

It is evident from the foregoing that a low-carbon, low-alloy martensitic steel has been provided which exhibits acceptably high tensile and yield strengths without an undue increase in hardness.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of producing a low carbon, low alloy, martensitic, cold-worked steel comprising the steps of providing a steel having from 0.20% to 0.30% carbon, 0.80% to 1.2% manganese, 3.25% to 4.00% nickel, 1.25% to 2.00% chromium, 0.25% to 0.50% molybdenum, 0.20% to 0.50% silicon, and the balance iron and residual amounts of other elements, austenitizing said steel by heating said steel to a temperature above its $A_3$ temperature, air cooling said steel to a temperature below its $M_3$ temperature to transform said steel to an essentially martensitic structure, tempering said steel by heating said steel to or maintaining the steel at a temperature below its $A_1$ temperature to obtain a hardness of not greater than about 456 Brinell, and a final treating step consisting of cold working said steel at ambient temperature to reduce its cross section by about 1/32 to ⅛ inch to increase its tensile and yield strengths without substantially increasing its tempered hardness and maintaining its elongation percent at above about 10.5 and its reduction of area percent at above about 46.9.

2. A method according to claim 1, wherein said steel is cooled from its austenitizing temperature to a temperature below its $A_1$ temperature and is held at that temperature unitl its internal temperature stablizes and then cooling the alloy to ambient temperature.

3. A method according to claim 1, wherein said alloy is cooled from its austenitizing temperature to ambient temperature and then reheated to a temperature below its $A_1$ temperature, and then cooled to ambient temperature.

4. A method according to claim 1, wherein said alloy is straightened after said cold working.

5. A method according to claim 1, wherein said cold working comprises cold drawing said steel to reduce its cross sectional area.

6. A low carbon, low alloy, martensitic steel produced in accordance with the method set forth in claim 1.

* * * * *